US008701438B1

(12) United States Patent
Kovel

(10) Patent No.: US 8,701,438 B1
(45) Date of Patent: Apr. 22, 2014

(54) RECONFIGURABLE BRACELET SYSTEM

(76) Inventor: William S. Kovel, Miami, FL (US)

( * ) Notice: Subject to any disclaimer, the term of this patent is extended or adjusted under 35 U.S.C. 154(b) by 111 days.

(21) Appl. No.: 13/135,435

(22) Filed: Jul. 5, 2011

(51) Int. Cl.
*A44C 5/00* (2006.01)

(52) U.S. Cl.
USPC ..... 63/3.1; 63/40; 63/11

(58) Field of Classification Search
USPC ..... 63/11, 29.1, 3, 3.1, 7–9, 15, 40; D11/3–4, 6, 16
See application file for complete search history.

(56) References Cited

U.S. PATENT DOCUMENTS

| | | | | | |
|---|---|---|---|---|---|
| 241,453 | A | * | 5/1881 | Untermeyer | 63/29.1 |
| 401,746 | A | * | 4/1889 | Johnstone | 63/1.12 |
| 1,558,418 | A | * | 10/1925 | Wendel | 63/15.65 |
| 1,866,320 | A | * | 7/1932 | Roskin | 63/15.4 |
| 2,003,950 | A | * | 6/1935 | Pejchar | 63/27 |
| 2,061,479 | A | * | 11/1936 | Philippe | 63/3.1 |
| 2,072,440 | A | * | 3/1937 | Bauer et al. | 63/15.7 |
| 2,324,430 | A | * | 7/1943 | Schalet et al. | 24/359 |
| D153,015 | S | * | 3/1949 | Pennino | D10/32 |
| D156,746 | S | * | 1/1950 | Kent | D10/32 |
| 2,624,092 | A | * | 1/1953 | Duerr | 24/598.5 |
| 2,629,981 | A | * | 3/1953 | Melik-Minassiantz | 368/281 |
| D170,997 | S | * | 12/1953 | Katz | D11/6 |
| 3,365,877 | A | * | 1/1968 | Altman | 368/285 |
| 3,668,890 | A | * | 6/1972 | Broido | 63/3 |
| D247,482 | S | * | 3/1978 | Schupp | D11/4 |
| 4,142,382 | A | * | 3/1979 | Fix et al. | 63/15.9 |
| D253,501 | S | * | 11/1979 | Hoch | D11/210 |
| 7,096,690 | B2 | * | 8/2006 | James | 63/3.1 |
| D529,834 | S | * | 10/2006 | Yurman | D11/3 |
| D542,689 | S | * | 5/2007 | Daas | D11/16 |
| D645,375 | S | * | 9/2011 | Alpert et al. | D11/3 |
| 2003/0106336 | A1 | * | 6/2003 | Gaskill | 63/3 |
| 2004/0255619 | A1 | * | 12/2004 | James | 63/29.1 |
| 2004/0255620 | A1 | * | 12/2004 | Chuang | 63/29.1 |

* cited by examiner

*Primary Examiner* — Jack W. Lavinder
*Assistant Examiner* — Abigail Morrell

(57) ABSTRACT

A band has a major section of a major length with first and second free ends spaced by an opening of a minor length. First and second minor sections in a generally J-shaped configuration are coupled to each free end. The minor sections have lower, upper and intermediate segments. Each upper segment ends in a semicircular free tip. An opening is formed at each free tip. A decorative gem stone has an upper region in a generally dome-shaped configuration projecting above the upper segment. A topper is removably positioned within the opening and has a decorative center and opposed ends. The opposed ends include similarly configured first and second rings adapted to be removably coupled to the first and second minor sections of the band.

1 Claim, 7 Drawing Sheets

FIG. 1
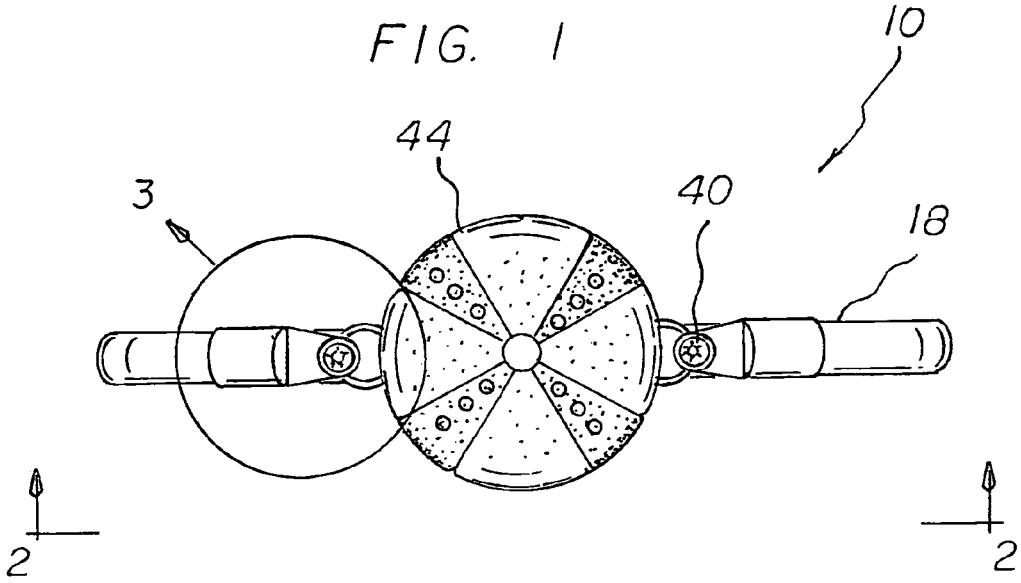
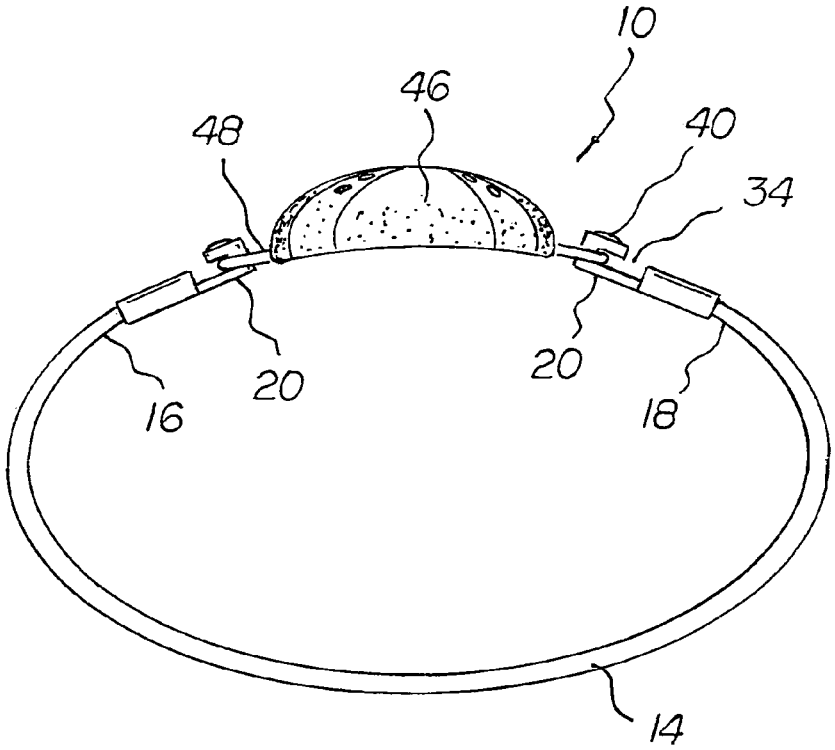
FIG. 2

FIG. 3
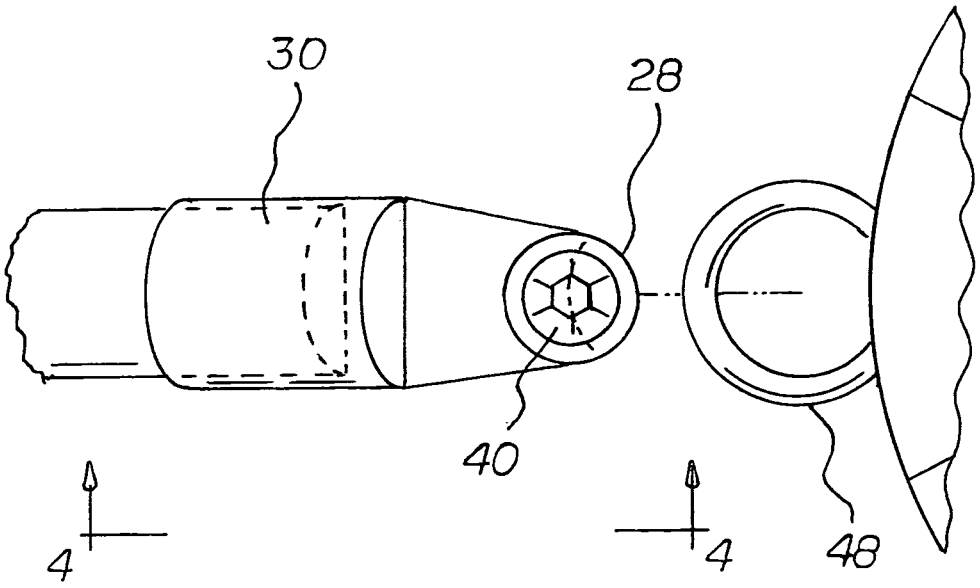
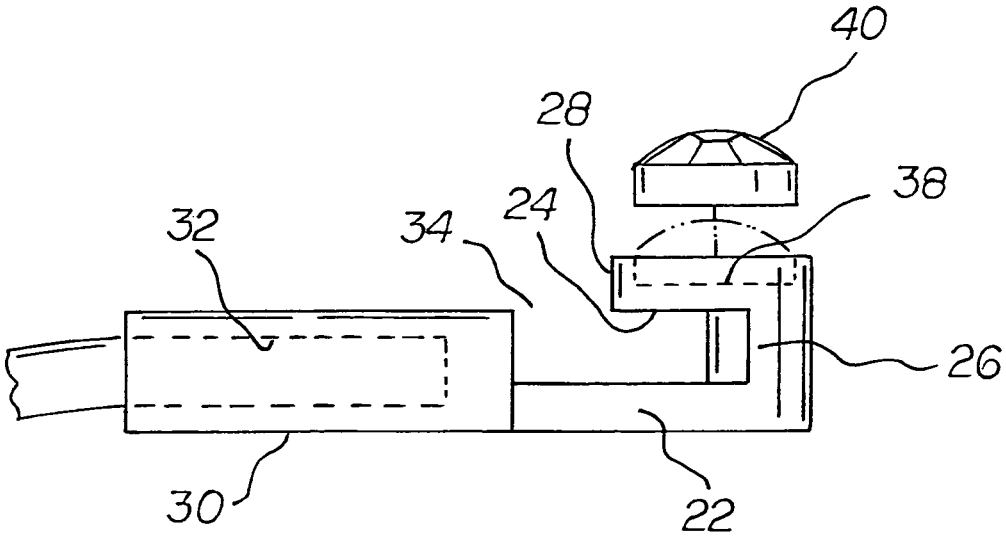
FIG. 4

FIG. 7
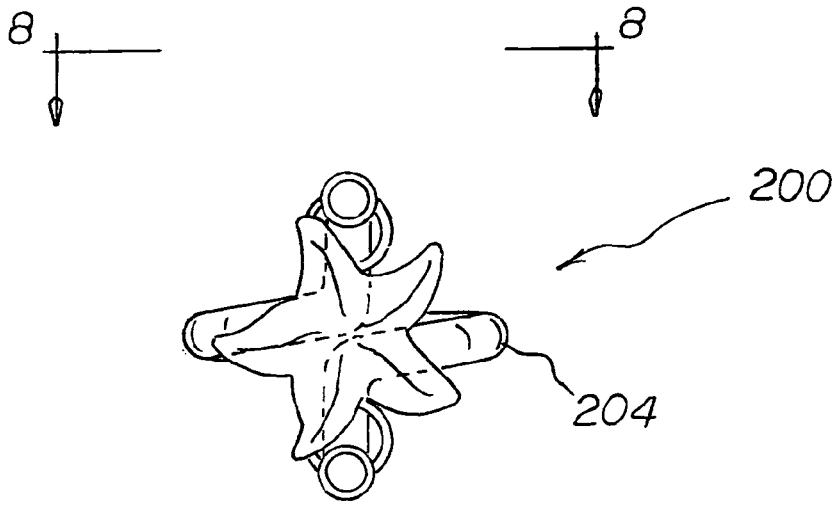
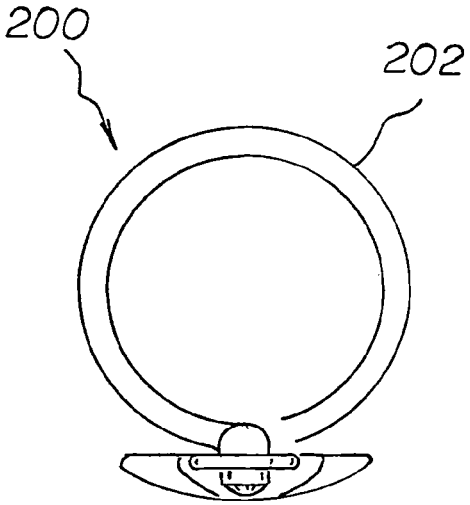
FIG 8
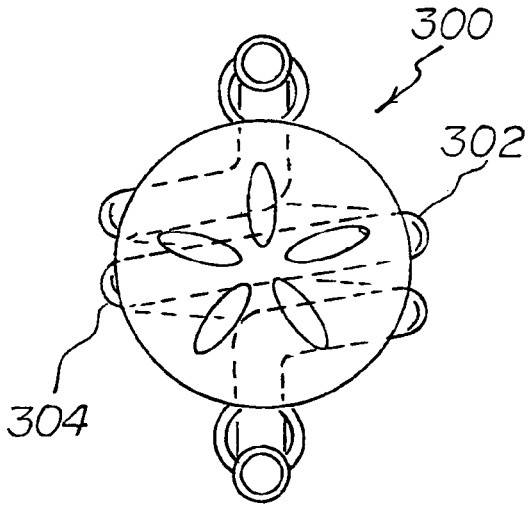
FIG. 7A

FIG. 11
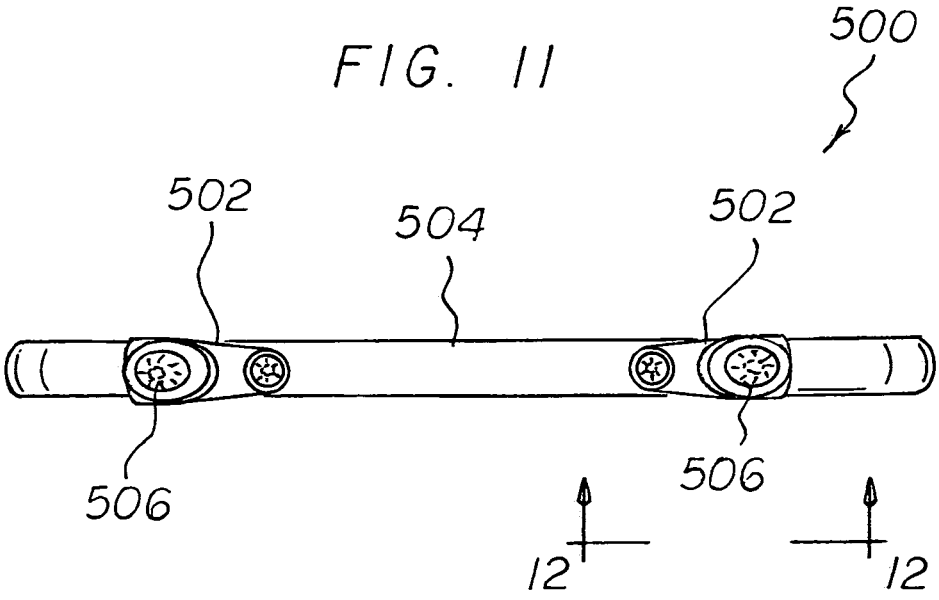
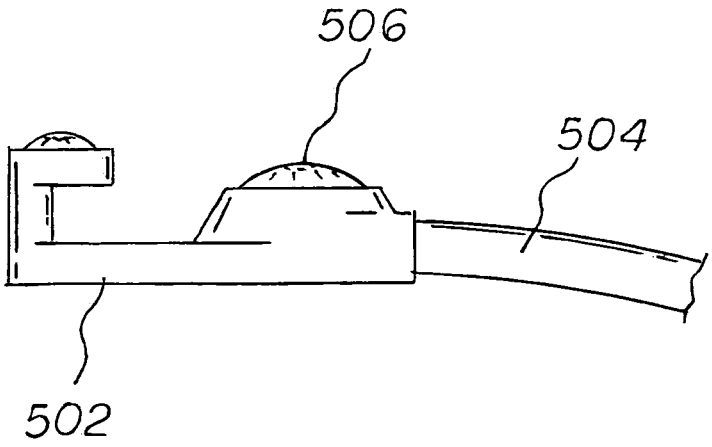
FIG. 12

FIG. 13
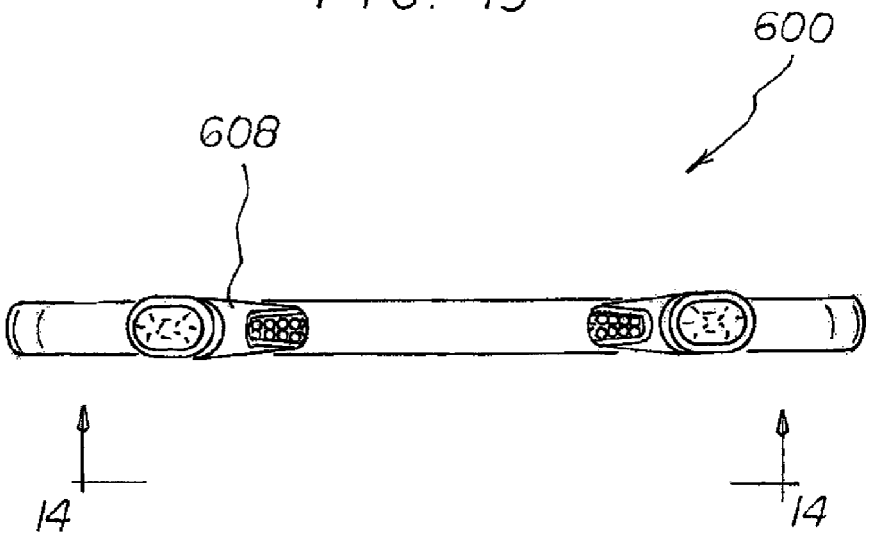
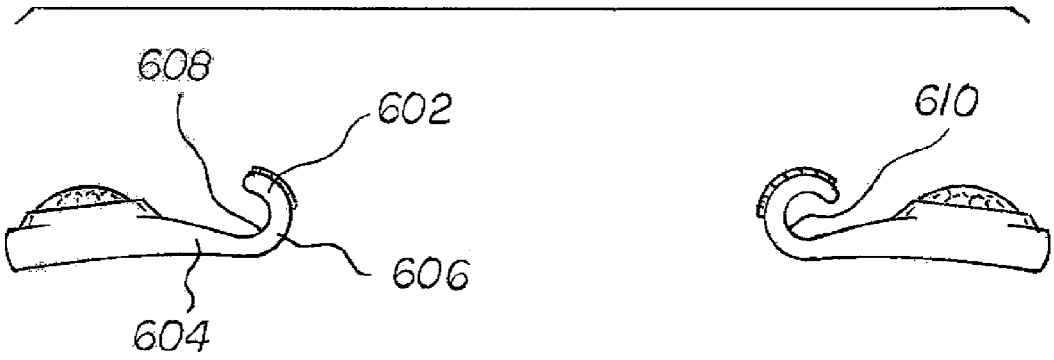
FIG. 14

RECONFIGURABLE BRACELET SYSTEM

BACKGROUND OF THE INVENTION

Field of the Invention

The present invention relates to a reconfigurable bracelet system and more particularly pertains to featuring any of a plurality of toppers positionable on a common wrist band for any of a plurality of design appearances, the positioning being done in a safe, secure and cost effective manner.

SUMMARY OF THE INVENTION

In view of the foregoing disadvantages inherent in the known types of jewelry systems of known designs and configurations now present in the prior art, the present invention provides an improved reconfigurable bracelet system. As such, the general purpose of the present invention, which will be described subsequently in greater detail, is to provide a new and improved reconfigurable bracelet system and method which has all the advantages of the prior art and none of the disadvantages.

To attain this, the present invention essentially comprises a reconfigurable bracelet system. First provided is a wrist band. The wrist band has a major section. The major section is in a partial oval configuration. The major section has a first free end. The major section has a second free end. The major section has a major length. The major section has interior surface and an exterior surface. The free ends are spaced by an opening of a minor length. The minor length is equal to between 13 percent and 30 percent of the major length. The band has a width. The width is less than 4 percent and up to 10 percent of the major length.

The wrist band has first and second minor sections. The minor sections are coupled to each free end. Each minor section is in a generally J-shaped configuration. The minor sections have a lower segment. The minor sections have an upper segment. The minor sections have an intermediate segment. The intermediate segment is provided between the lower and upper segments. The lower segments are formed as extensions of the major section of the wrist band. The upper segments are formed at an elevation radially exterior of the exterior surface. The upper segments have a semicircular free tip. The upper segments terminate in the semicircular free tip. The intermediate segment is formed at 90 degrees from the lower and upper segments. Each lower segment is longer than each upper segment. Each short segment is longer than each intermediate segment. Each minor connector has a generally cylindrical joining section, cylindrical or semicircular depending on the shape of the major connector. The joining portion has a recess. In this manner the minor sections are secured to the major section. An opening is provided. The opening is provided between each joining portion and an associated free tip.

Each upper segment being has a cylindrical recess. A decorative gem stone is provided. The gem stone has a cylindrical lower region. The lower region of the gem stone is secured in an associated recess. Each gem stone has an upper region. The upper region of the gem stone is in a generally dome-shaped configuration. The upper region of the gem stone projects above the upper segment.

Provided last is a topper. A topper is to be defined as any plurality of removable central or center designs. The topper is removably positioned within the opening. The topper has a decorative center. The topper has opposed ends or sides. Some of the topper designs are situated up and down and some are left to right. So what you might call ends that are placed up and down consequently may become sides in other designs. See the seahorse drawing in FIG. 9. The decorative centers of the toppers are adapted to take any one of a plurality of motifs. The motifs are such as sea related designs, i.e., a star fish, a sea horse, a sea urchin, etc. The opposed ends include similarly configured first and second rings. The rings are adapted to be removably coupled to the first and second minor sections of the wrist band. Each ring provides an arcuate surface. The arcuate surface is adapted to slide over the domed surface of the stone. In this manner a user is assisted in coupling the topper to the wrist band.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reconfigurable bracelet system which has all of the advantages of the prior art jewelry systems of known designs and configurations and none of the disadvantages.

It is another object of the present invention to provide a new and improved reconfigurable bracelet system which may be easily and efficiently manufactured and marketed.

It is further object of the present invention to provide a new and improved reconfigurable bracelet system which is of durable and reliable constructions.

An even further object of the present invention is to provide a new and improved reconfigurable bracelet system which is susceptible of a reasonable cost of manufacture with regard to both materials and labor, and which accordingly is then susceptible of reasonable prices of sale to the consuming public, thereby making such reconfigurable bracelet system reasonably available to the buying public.

Even still another object of the present invention is to provide a reconfigurable bracelet system for featuring any of a plurality of toppers positionable on a common wrist band for any of a plurality of design appearances, the positioning being done in a safe, secure and economical manner.

Lastly, it is an object of the present invention to provide a new and improved reconfigurable bracelet system. A band has a major section of a major length. The major section has first and second free ends spaced by an opening of a minor length. First and second minor sections are coupled to each free end. The minor sections have a generally J-shaped configuration. The minor sections have lower, upper and intermediate segments. Each upper segment ends in a semicircular free tip. An opening is formed at each free tip. A decorative gem stone has an upper region in a generally dome-shaped configuration projecting above the upper segment. A topper is removably positioned within the opening. The topper has a decorative center and opposed ends. The opposed ends include similarly configured first and second rings adapted to be removably coupled to the first and second minor sections of the band.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a reconfigurable bracelet system constructed in accordance with the principles of the present invention.

FIG. 2 is a side elevational view taken along line 2-2 of FIG. 1.

FIG. 3 is an enlarged exploded plan view taken at circle 3 of FIG. 1.

FIG. 4 is an enlarged exploded side elevational view taken along line 4-4 of FIG. 3.

FIGS. 7 and 7A are plan views of rings constructed in accordance with alternate embodiments of the invention.

FIG. 8 is a side elevational view taken along line 8-8 of FIG. 7.

FIG. 11 is a plan view of a bracelet constructed in accordance with another alternate embodiment of the invention.

FIG. 12 is a side elevational view taken along line 12-12 of FIG. 11.

FIG. 13 is a plan view of a bracelet constructed in accordance with a final alternate embodiment of the invention.

FIG. 14 is a side elevational view taken along line 13-13 of FIG. 13.

The same reference numerals refer to the same parts throughout the various Figures.

DESCRIPTION OF THE PREFERRED EMBODIMENT

Figure 5:
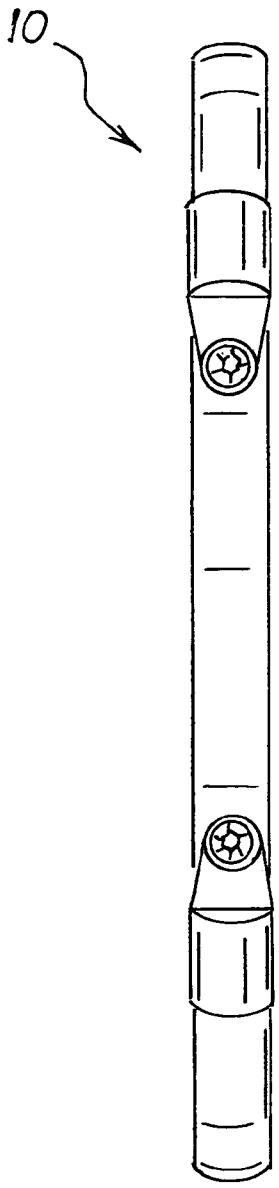
FIGS. 5 and 6 are plan views of alternate embodiments of the invention of the prior Figures illustrating wrist bands of different widths.

With reference now to the drawings, and in particular to FIG. 1 thereof, the preferred embodiment of the new and improved reconfigurable bracelet system embodying the principles and concepts of the present invention and generally designated by the reference numeral 10 will be described.

The present invention, the reconfigurable bracelet system 10 is comprised of a plurality of components. Such components in their broadest context include a band, first and second minor sections, a decorative gem stone and a topper. Such components are individually configured and correlated with respect to each other so as to attain the desired objective.

First provided is a wrist band 14. The wrist band has a major section. The major section is in a partial oval configuration. The major section has a first free end 16. The major section has a second free end 18. The major section has a major length. The major section has interior surface and an exterior surface. The free ends are spaced by an opening of a minor length. The minor length is equal to between 13 percent and 30 percent of the major length. The band has a width. The width is less than 4 percent and up to 10 percent of the major length.

The wrist band has first and second minor sections 20. The minor sections are coupled to each free end. Each minor section is in a generally J-shaped configuration. The minor sections have a lower segment 22. The minor sections have an upper segment 24. The minor sections have an intermediate segment 26. The intermediate segment is provided between the lower and upper segments. The lower segments are formed as extensions of the major section of the wrist band. The upper segments are formed at an elevation radially exterior of the exterior surface. The upper segments have a semicircular free tip 28. The upper segments terminate in the semicircular free tip. The intermediate segment is formed at 90 degrees from the lower and upper segments. Each lower segment is longer than each upper segment. Each short segment is longer than each intermediate segment. Each minor section has a generally cylindrical joining portion 30. The joining portion has a recess 32. In this manner the minor sections are secured to the major section. An opening 34 is provided. The opening is provided between each joining portion and an associated free tip.

Each upper segment being has a cylindrical recess 38. A decorative gem stone 40 is provided. The gem stone has a cylindrical lower region. The lower region of the gem stone is secured in an associated recess. Each gem stone has an upper region. The upper region of the gem stone is in a generally dome-shaped configuration. The upper region of the gem stone projects above the upper segment.

Provided last is a topper 44. The topper is removably positioned within the opening. The topper has a decorative center 46. The decorative center consists of a cast or hand wrought metal design element in or upon which assorted mother of pearl inlay, or natural or synthetic gemstones, or any of a variety of other materials are placed. The topper has opposed ends. The decorative centers of the toppers are adapted to take any one of a plurality of motifs. The motifs are such as sea related designs, i.e., a star fish, a sea horse, a sea urchin, etc. Other motifs include a rainforest collection and a African bush collection and a heartland collection which is about the animals and nature away from the coast such as owls and dragonflies and snails and horses and hummingbirds, etc. It is about the natural world all over the planet with some nature pattern designs like a bee honey comb and tree bark and abstract designs too. The toper designs, however, are not limited to either nature or fashion designs, nor to a celebration of locations or vacation destinations or cities or holidays or any other design idea or ideas, as different and new design motifs are to be added on an ongoing basis. The opposed ends include similarly configured first and second rings 48. The rings are adapted to be removably coupled to the first and second minor sections of the wrist band. Each ring provides an arcuate surface. The arcuate surface is adapted to slide over the domed surface of the stone and once over the opening, the topper is more easily guided into its final positioning. In this manner a user is aided in its installation.

Figure 6:
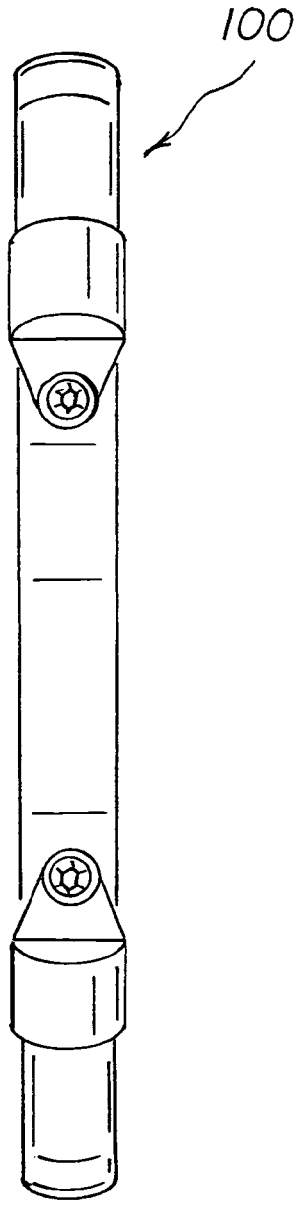

In an alternate embodiment 100 of the present invention, the band has a width greater than 4 percent of the major length. Note FIG. 6.

In another alternate embodiment 200 of the present invention, the band is a ring 202. The ring has a single loop 204. Note FIGS. 7 and 8.

In another alternate embodiment 300 of the present invention, the band is a ring 302. The ring has plural loops 304. Note FIG. 7A.

The ring embodiments of FIGS. 7, 8 and 7A are readily adapted to be worn on any finger or fingers including the thumb or thumbs. In this further embodiment, both in the ring and the segments of the bracelet, the gemstone may be omitted in future designs, both purely as a design feature alone, and secondly as a practical measure to reduce the price somewhat for the price conscious consumer. The basic coupling mechanisms remain the same.

Figure 9:
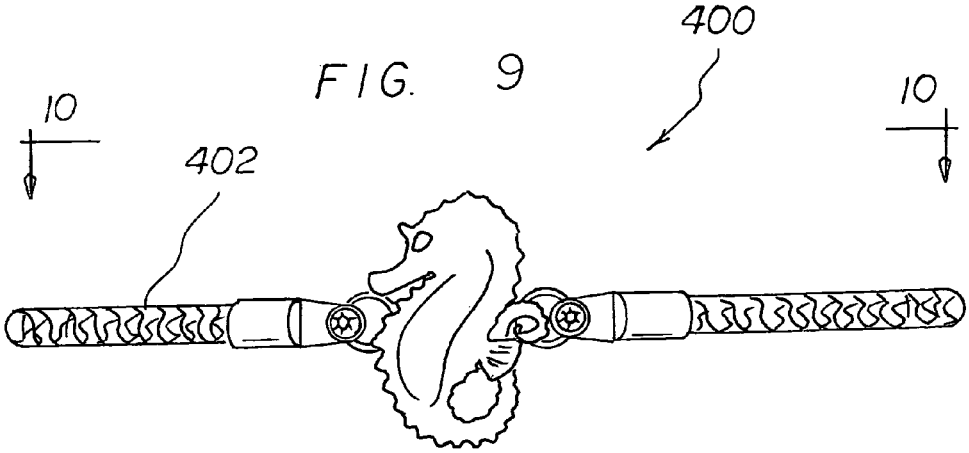
FIG. 9 is a plan view of a bracelet constructed in accordance with another alternate embodiment of the invention.
Figure 10:
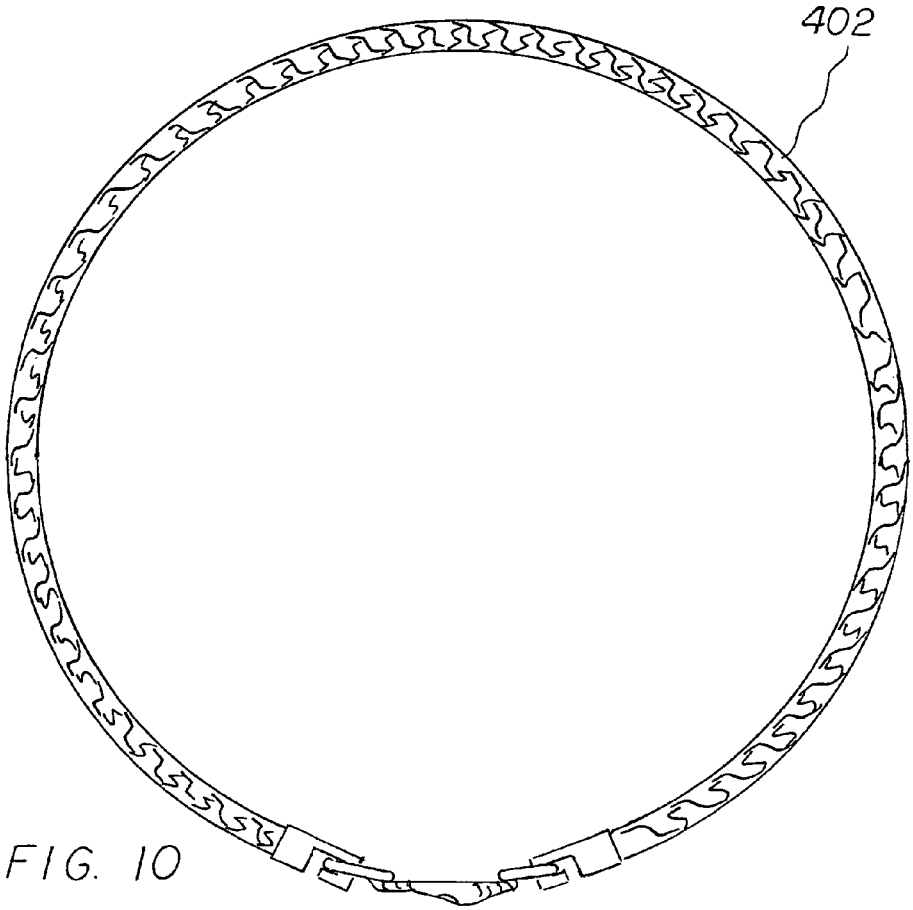
FIG. 10 is a side elevational view taken along line 10-10 of FIG. 9.

In another alternate embodiment 400 of the present invention, the band is a segmented member 402. In this manner increased flexibility is provided. Note FIGS. 9 and 10.

In another alternate embodiment 500 of the present invention, each minor section 502 is integrally formed with an associated free end of the band 504. Each minor section further includes a supplemental gem stone 506. Note FIGS. 11 and 12.

In the final alternate embodiment 600 of the present invention, the upper and lower and intermediate segments 602, 604, 606 are in a curved configuration. A first minor section 608 is provided. A second minor section 610 is also provided. The curved configuration of the first minor section is less than 180 degrees. The curved configuration of the second minor section is greater than 180 degrees. Note FIGS. 13 and 14.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reconfigurable bracelet system (10) featuring an interchangeable topper positionable on a common wrist band, the system comprising, in combination:

the wrist band (14) formed of a major section in a partial oval configuration with a first free end (16) and a second free end (18), the major section having a major length with an interior surface and an exterior surface, the free ends being spaced by an opening of a minor length equal to between 13 percent and 30 percent of the major length, the band has a width up to 10 percent of the major length;

first and second minor sections (20) coupled to each free end, each minor section having a generally J-shaped configuration with a lower segment (22) and an upper segment (24) and an intermediate segment (26) between the lower and upper segments, the lower segments formed as extensions of the major section of the wrist band, the upper segments formed at an elevation radially exterior of the exterior surface, each upper segment terminating in a semicircular free tip (28), the intermediate segment formed at 90 degrees from the lower and upper segments, each lower segment being longer than each upper segment, each upper segment being longer than each intermediate segment, each minor section having a generally cylindrical joining portion (30) with a recess (32) for securing the minor sections to the major section, an opening (34) formed between each joining portion and an associated one of the free tips;

each upper segment being formed with a cylindrical recess (38), a decorative gem stone (40) having a cylindrical lower region secured in an associated one of the recesses, each gem stone having an upper region in a generally dome-shaped configuration projecting above the upper segment; and the topper (44) removably positioned within the openings, the topper formed of a decorative center (46) and opposed ends, the opposed ends including similarly configured first and second rings (48) adapted to be removably coupled to the first and second minor sections of the wrist band, each ring providing an arcuate surface adapted to slide over the upper region of the stone to assist a user in coupling the topper to the wrist band.

* * * * *